US010061225B2

(12) United States Patent
Isoda

(10) Patent No.: US 10,061,225 B2
(45) Date of Patent: Aug. 28, 2018

(54) TONER AMOUNT DETECTION SENSOR AND IMAGE FORMING APPARATUS

(71) Applicant: KYOCERA Document Solutions Inc., Osaka-shi, Osaka (JP)

(72) Inventor: Keisuke Isoda, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/492,001

(22) Filed: Apr. 20, 2017

(65) Prior Publication Data

US 2017/0308003 A1 Oct. 26, 2017

(30) Foreign Application Priority Data

Apr. 22, 2016 (JP) ..... 2016-085954

(51) Int. Cl.
*G03G 15/08* (2006.01)

(52) U.S. Cl.
CPC ..... *G03G 15/0827* (2013.01)

(58) Field of Classification Search
CPC ..... G03G 15/0827; G03G 15/0831
See application file for complete search history.

(56) References Cited

U.S. PATENT DOCUMENTS 7,315,378 B2 * 1/2008 Phelan ..... G01N 21/4738 356/39
2004/0042816 A1 * 3/2004 Fukuda ..... G03G 15/0194 399/98
2004/0251435 A1 * 12/2004 Sawayama ..... G01N 21/55 250/559.16
2006/0239705 A1 * 10/2006 Ishibashi ..... G03G 15/50 399/49
2008/0047157 A1 * 2/2008 Takayama ..... G03G 15/0131 33/706
2008/0145089 A1 * 6/2008 Takahashi ..... G03G 15/50 399/74
2008/0292360 A1 * 11/2008 Hirai ..... G01J 1/04 399/220
2009/0202263 A1 * 8/2009 Yoshida ..... G03G 15/0131 399/49

(Continued)

FOREIGN PATENT DOCUMENTS

JP H10-281991 A 10/1998
JP 2011-170165 A 9/2011

*Primary Examiner* — David Bolduc
(74) *Attorney, Agent, or Firm* — Viering, Jentschura & Partner mbB

(57) ABSTRACT

A toner amount detection sensor has a substrate, and a case housing. In the substrate, the light emitting element, the first light receiving element, and the second light receiving element are attached with an interval to the same first surface. In the substrate, first and second slits and are provided between a region where the light emitting element is attached and regions where the first light receiving element and the second light receiving element are attached. In the case housing, first and second light shielding walls and are disposed in such a manner as to extend to reach the inside of the first and second slits and when attached to the substrate and first and second light shielding walls and are provided between the light emitting element and the first light receiving element and between the light emitting element and the second light receiving element.

8 Claims, 6 Drawing Sheets

(56) References Cited

U.S. PATENT DOCUMENTS

| | | | | |
|---|---|---|---|---|
| 2010/0054774 | A1* | 3/2010 | Yamasaki | G03G 15/0131 399/49 |
| 2010/0266302 | A1* | 10/2010 | Suzuki | G01N 21/55 399/49 |
| 2011/0052239 | A1* | 3/2011 | Tanaka | G03G 15/0131 399/74 |
| 2011/0058823 | A1* | 3/2011 | Hirai | G03G 15/0131 399/15 |
| 2012/0237246 | A1* | 9/2012 | Taishi | G03G 15/5058 399/74 |
| 2013/0164007 | A1* | 6/2013 | Yanata | G03G 15/50 399/49 |
| 2013/0272740 | A1* | 10/2013 | Nakagawa | G01N 21/55 399/74 |
| 2016/0147177 | A1* | 5/2016 | Isoda | G03G 15/5041 399/74 |

* cited by examiner

TONER AMOUNT DETECTION SENSOR AND IMAGE FORMING APPARATUS

INCORPORATION BY REFERENCE

The disclosure of Japanese Patent Application No. 2016-085954 filed on Apr. 22, 2016 including the specification, drawings and abstract is incorporated herein by reference in its entirety.

BACKGROUND

This disclosure relates to a toner amount detection sensor and an image forming apparatus.

In an image forming apparatus typified by a multifunctional peripheral and the like, an image of a document is read by an image reading unit, and then a photoconductor provided in an image forming unit is irradiated with light based on the read image to form an electrostatic latent image on the photoconductor. Thereafter, a developing agent, such as a charged toner, is supplied onto the formed electrostatic latent image to form a visible image, the visible image is transferred and fixed to a fed sheet, and then the sheet is discharged to the outside of the apparatus.

Herein, in a certain image forming apparatus capable of forming a full color image, yellow, magenta, cyan, and black colors are overlapped to form a full color image. In this case, a toner of each color is once transferred to a transfer belt as an intermediate transfer body, and then a full color image is transferred to a sheet. In the formation of the full color image, it is necessary to perform correction at predetermined timing in order to maintain color development properties and color reproducibility. In the correction, the toner amount on the transfer body is detected, and then adjustment of a development bias value, adjustment of the exposure amount, adjustment of exposure timing, and the like are performed so that a proper toner amount is set.

Herein, a technique on a sensor detecting the toner amount is known from the past.

According to a former typical optical sensor, the glossiness is measured by irradiating the surface of an object with measuring light having a predetermined angle of incidence with a projector, and then measuring a reflected light from the object surface with a light receiving unit at the reflection angle which is the same angle as the angle of incidence. Such an optical sensor has a feature in that the projector emits a single wavelength and a polarization device is provided, so that the object surface is irradiated with light having polarization in a single direction, a reflected light from the object surface is caused to transmit through a polarization beam splitter to be thereby divided into a reflected light component having polarization in the same direction as that of the measuring light and a reflected light component having a direction different therefrom, each reflected light component is measured by light receiving means provided to each reflected light component, and then the outputs from the two light receiving means are calculated to measure the glossiness.

A former typical image forming apparatus has a recording medium conveying belt which is rotatably stretched by a plurality of roller members. In such an image forming apparatus, at least one or more specular reflection light detection type optical sensors and at least one or more specular reflection light/scattering light simultaneous detection type optical sensors are disposed facing an intermediate transfer body and at least one or more specular reflection light detection type optical sensors are disposed facing the recording medium conveying belt or a second image carrying body. Such an image forming apparatus performs black toner adhesion amount control using the at least one or more specular reflection light detection type optical sensors disposed facing the recording medium conveying belt or the second image carrying body and the adhesion amount control of toners other than the black toner is performed using the at least one or more specular reflection light/scattering light simultaneous detection type optical sensors disposed facing the intermediate transfer body. Furthermore, such an image forming apparatus has a feature of performing each color alignment using the at least one or more specular reflection light/scattering light simultaneous detection type optical sensors disposed facing the intermediate transfer body and the at least one or more specular reflection light detection type optical sensors.

SUMMARY

In one aspect of this disclosure, a toner amount detection sensor detects the toner amount of a visible image by toner formed on the surface of a transfer body. The toner amount detection sensor has a light emitting element, a light receiving element, a toner amount calculation unit, a substrate, and a case housing. The light emitting element emits light to the surface side of a transfer body at a predetermined angle of incidence. The light receiving element receives a reflected light reflected from the surface side of the transfer body. The toner amount calculation unit calculates the toner amount from the light quantity of a reflected light received by the light receiving element. On the substrate, the light emitting element and the light receiving element are attached with an interval to the same first surface. The case housing is attached to the substrate and covers the upper surface side of the light emitting element and the light receiving element. In the substrate, a slit is formed between a region where the light emitting element is attached and a region where the light receiving element is attached. The case housing is provided with a light shielding wall which is disposed in such a manner as to extend to reach the inside of the slit when attached to the substrate and which shields light between the light emitting element and the light receiving element.

In another aspect of this disclosure, an image forming apparatus has an image forming unit forming a visible image by toner and having a toner amount detection sensor detecting the toner amount of the visible image by toner formed on the surface of a transfer body. The toner amount detection sensor detects the toner amount of the visible image by toner formed on the surface of the transfer body. The toner amount detection sensor has a light emitting element, a light receiving element, a toner amount calculation unit, a substrate, and a case housing. The light emitting element emits light to the surface side of the transfer body at a predetermined angle of incidence. The light receiving element receives a reflected light reflected from the surface side of the transfer body. The toner amount calculation unit calculates the toner amount from the light quantity of a reflected light received by the light receiving element. On the substrate, the light emitting element and the light receiving element are attached with an interval to the same first surface. The case housing is attached to the substrate and covers the upper surface side of the light emitting element and the light receiving element. In the substrate, a slit is formed between a region where the light emitting element is attached and a region where the light receiving element is attached. The case housing is provided with a light shielding wall which is disposed in such a manner as to extend to reach the inside of the slit when attached to the substrate and which shields light between the light emitting element and the light receiving element.

DETAILED DESCRIPTION

Figure 1:
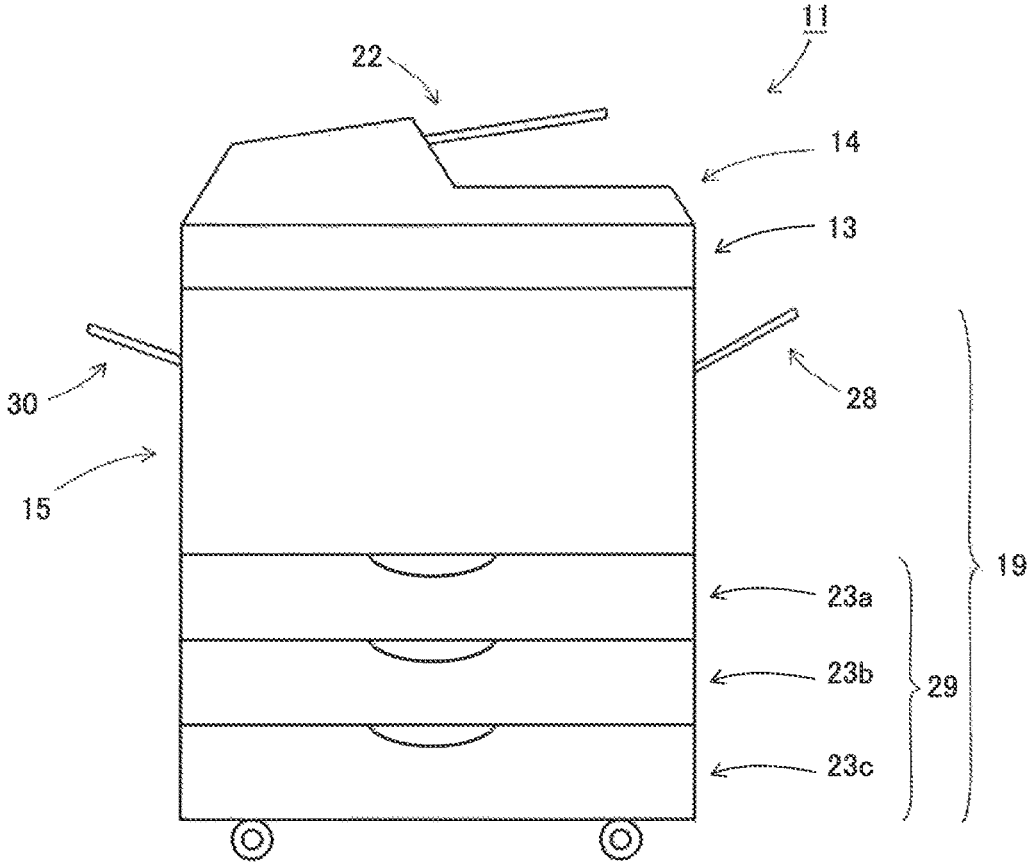
FIG. 1 is a schematic view illustrating the appearance of a multifunctional peripheral when an image forming apparatus according to one embodiment of this disclosure is applied to the multifunctional peripheral.
Figure 2:
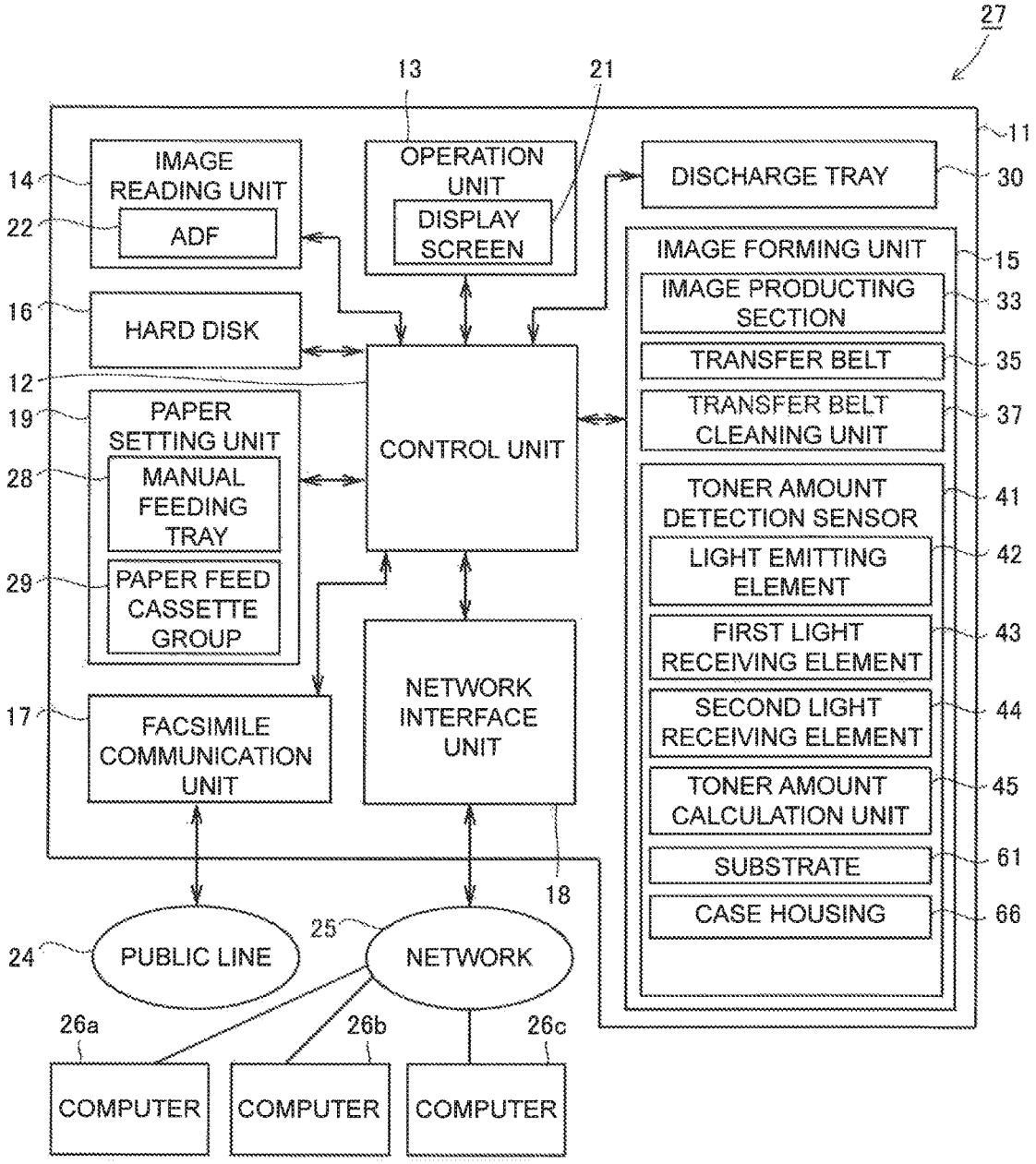
FIG. 2 is a block diagram illustrating the configuration of the multifunctional peripheral illustrated in FIG. 1.

Hereinafter, an embodiment of this disclosure is described. First, the configuration of a multifunctional peripheral when an image forming apparatus according to one embodiment of this disclosure is applied to the multifunctional peripheral is described. FIG. 1 is a schematic view illustrating the appearance of a multifunctional peripheral when an image forming apparatus according to one embodiment of this disclosure is applied to the multifunctional peripheral. FIG. 2 is a block diagram illustrating the configuration of the multifunctional peripheral when the image forming apparatus according to one embodiment of this disclosure is applied to the multifunctional peripheral.

With reference to FIG. 1 and FIG. 2, a multifunctional peripheral 11 has a control unit 12, an operation unit 13, an image reading unit 14, a paper setting unit 19, an image forming unit 15, a discharge tray 30, a hard disk 16, a facsimile communication unit 17, and a network interface unit 18 for performing connection with the network 25.

The control unit 12 controls the entire multifunctional peripheral 11. The operation unit 13 has a display screen 21 displaying information transmitted from the multifunctional peripheral 11 side and the contents of an input of a user. The operation unit 13 causes a user to input image formation conditions, such as the number of prints and gradation, and ON or OFF of the power supply. The image reading unit 14 contains an ADF (Auto Document Feeder) 22 which automatically conveys a set document to a reading unit. The image reading unit 14 reads image data of a document. The paper setting unit 19 contains a manual feeding tray 28 to which paper is manually set and a paper feed cassette group 29 capable of storing a plurality of sheets different in size. The paper setting unit 19 sets a sheet to be fed to the image forming unit 15. The image forming unit 15 forms an image based on read image data or image data transmitted through the network 25. The discharge tray 30 discharges a sheet after forming an image on the sheet by the image forming unit 15. The hard disk 16 stores the transmitted image data, the input image formation conditions, and the like. The facsimile communication unit 17 is connected to a public line 24 and performs facsimile transmission and facsimile reception The multifunctional peripheral 11 has a DRAM (Dynamic Random Access Memory) writing and reading-out image data and the like but illustration and a description thereof is omitted. The arrows in FIG. 2 indicate the flow of control signals and data on control and images. As illustrated in FIG. 1, the paper feed cassette group 29 is configured from three paper feed cassettes 23*a*, 23*b*, and 23*c* in this embodiment.

The multifunctional peripheral 11 operates as a copying machine by forming an image in the image forming unit 15 using image data of a document read by the image reading unit 14. The multifunctional peripheral 11 operates as a printer by forming an image in the image forming unit 15, and then printing the image on a sheet using image data transmitted from computers 26*a*, 26*b*, and 26*c* connected to the network 25 through the network interface unit 18. More specifically, the image forming unit 15 operates as a printing unit which prints a requested image. The multifunctional peripheral 11 operates as a facsimile device by forming an image in the image forming unit 15 through the DRAM using image data transmitted from the public line 24 through the facsimile communication unit 17 and transmitting image data of a document read by the image reading unit 14 to the public line 24 through the facsimile communication unit 17. The multifunctional peripheral 11 has a plurality of functions relating to image processing, such as a copying function, a printer function, and a facsimile function. Furthermore, the multifunctional peripheral 11 has a function capable of setting each function in detail.

An image formation system 27 containing the multifunctional peripheral 11 according to one embodiment of this disclosure has the multifunctional peripheral 11 of the configuration described above and the plurality of computers 26*a*, 26*b*, and 26*c* connected to the multifunctional peripheral 11 through the network 25. In this embodiment, three computers are illustrated as the plurality of computers 26*a* to 26*c*. Each of the computers 26*a* to 26*c* can perform printing by performing a print request through the network 25 to the multifunctional peripheral 11. Configurations may be acceptable in which the multifunctional peripheral 11 and the computers 26*a* to 26*c* are connected through wire using a LAN (Local Area Network) cable or the like or connected by radio and another multifunctional peripheral and a server are connected in the network 25.

Figure 3:
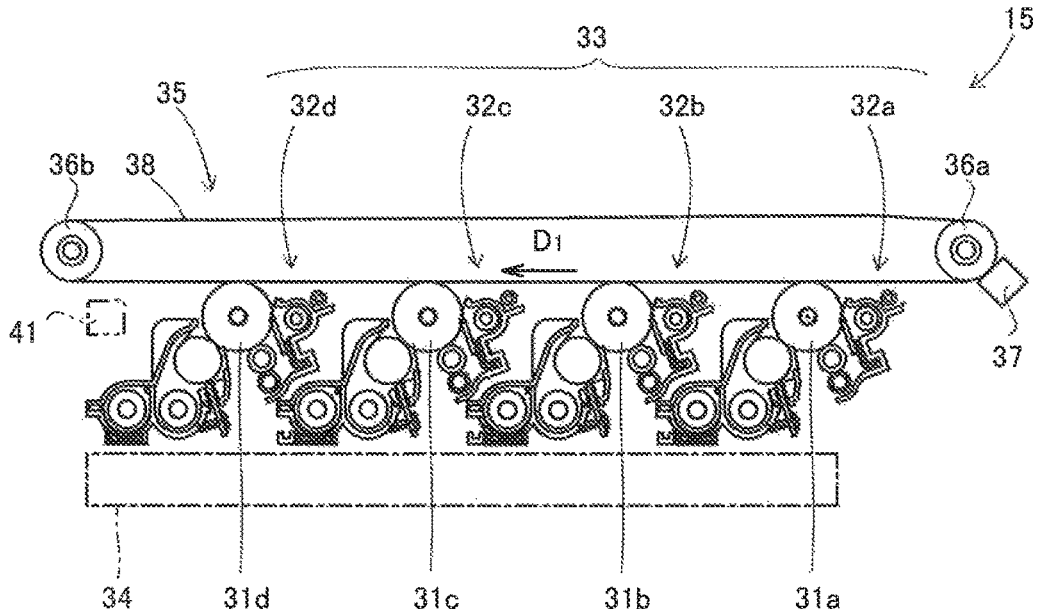
FIG. 3 is an outside view illustrating the schematic configuration of an image forming unit.

Next, the configuration of the image forming unit 15 provided in the multifunctional peripheral 11 is described in more detail. FIG. 3 is a cross-sectional view illustrating the schematic configuration of the multifunctional peripheral 11 according to one embodiment of this disclosure. In FIG. 3, hatching of members is omitted from the viewpoint of ease of understanding. FIG. 3 is a cross-sectional view when the multifunctional peripheral 11 is cut along the plane extending in the vertical direction.

With reference to FIG. 3, the image forming unit 15 contains photoconductors 31*a*, 31*b*, 31*c*, and 31*d*, and the image forming unit 15 has an image producing section 33 containing four image producing units 32*a*, 32*b*, 32*c*, and 32*d* corresponding to four colors of yellow, magenta, cyan, and black, respectively, an LSU (Laser Scanner Unit) 34 exposing light to the four image producing units 32*a* to 32*d* based on the image read by the image reading unit 14, a transfer belt 35 as an intermediate transfer body to which a visible image by toner formed by the image producing units 32*a* to 32*d* is temporarily transferred before transferred to a sheet, and a transfer belt cleaning unit 37 removing a toner remaining on the transfer belt 35 with a blade or the like. The LSU 34 is schematically illustrated by the alternate long and short dash lines. The transfer belt cleaning unit 37 is also schematically illustrated. The image forming unit 15 has a so-called quadruple tandem type development system.

The transfer belt 35 has an endless shape and transfers a visible image formed by the image producing units 32*a* to 32*d* of four colors of yellow, magenta, cyan, and black, respectively, while rotating in one direction by a driving roller 36*b* and a driven roller 36*a*. The rotation direction of the transfer belt 35 is indicated by the arrow $D_1$ in FIG. 3. Among the image producing units 32*a* to 32*d*, the yellow image producing unit 32*a* is disposed on the most upstream side and the black image producing unit 32*d* is disposed on the most downstream side in the rotation direction of the transfer belt 35. The transfer belt cleaning unit 37 is disposed on the upstream side of the yellow image producing unit 32*a*.

The visible image by toner transferred onto the transfer belt 35 is transferred to the conveyed sheet, and then fixed to the sheet by a fixing unit which is not illustrated. After the fixing, the sheet is discharged to the outside of the multifunctional peripheral 11, specifically discharged to the discharge tray 30. After the visible image by toner is transferred to the sheet, the toner remaining on the transfer belt 35 is removed by the transfer belt cleaning unit 37. Then, next image formation is performed.

The multifunctional peripheral 11 can perform monochrome printing using only the black image producing unit 32*d*. The multifunctional peripheral 11 can perform color printing using at least any one of the yellow image producing unit 32*a*, the magenta image producing unit 32*b*, and the cyan image producing units 32*c*.

Herein, the control unit 12 provided in the multifunctional peripheral 11 corrects the concentration, the position, and color shift of the visible image to be formed on the transfer belt 35 by the image producing units 32*a* to 32*d*, for example, at the timing when the number of printed sheets has reached a predetermined number of sheets, specifically at every timing when the number of sheets of image formation has reached 1000 sheets, at the timing when the drive time has reached a predetermined time, at the timing when the environmental change has occurred, specifically at the timing when the temperature or the humidity has dramatically changed, or at the timing of exchanging some of the units configuring the multifunctional peripheral 11. The image forming unit 15 forms a patch image for correcting the visible image by toner on the transfer belt 35 when a periodical maintenance is performed, for example. Then, the amount of a toner to be given to the transfer belt 35, the timing when laser light is emitted by the LSU 34, the intensity, and the like are changed using the patch image to adjust the concentration of the toner, the color shift, and the like to perform the correction. The formed patch image is not transferred to a sheet and is removed from a surface 38 of the transfer belt 35 by the transfer belt cleaning unit 37.

In such correction, a toner amount detection sensor detecting the toner amount of the patch image formed on the transfer belt 35 is used. More specifically, the image forming unit 15 has a toner amount detection sensor 41 measuring the toner amount of the visible image by toner transferred onto the transfer belt 35.

Figure 4:
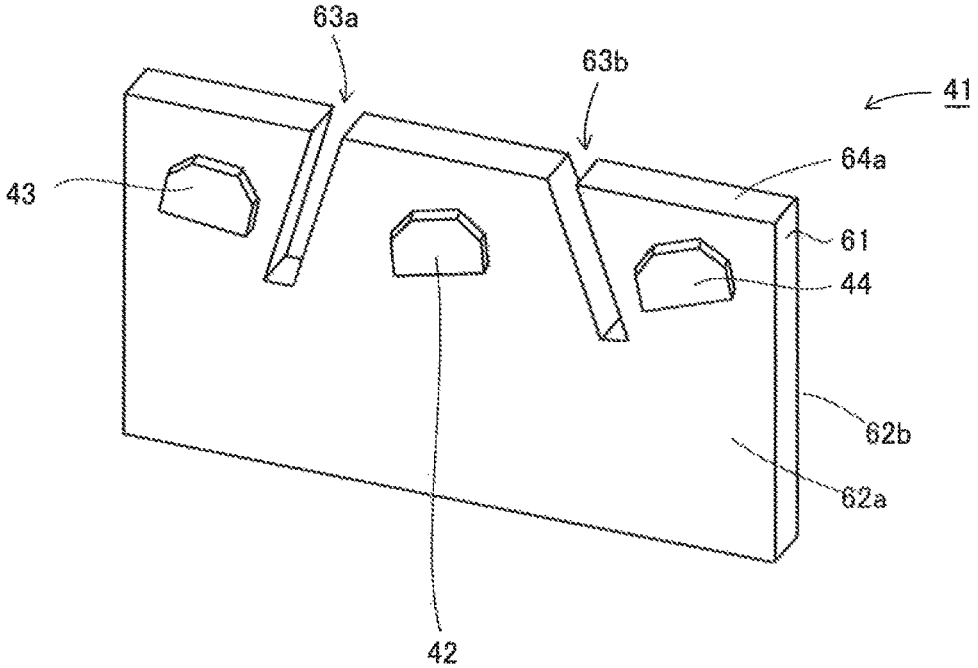
FIG. 4 is a schematic perspective view illustrating the appearance of a toner amount detection sensor according to one embodiment of this disclosure.
Figure 5:
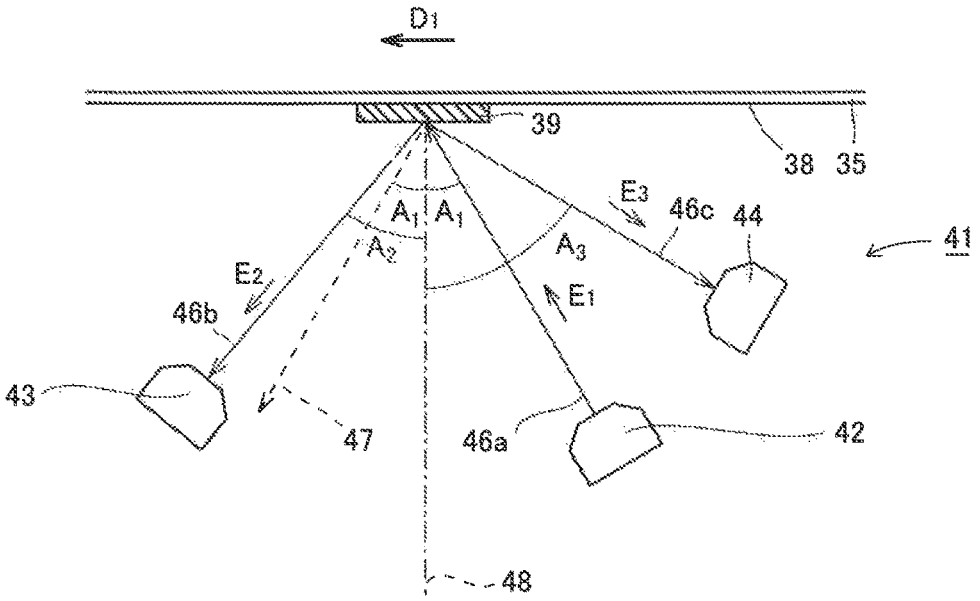
FIG. 5 is a view illustrating the configuration of the toner amount detection sensor illustrated in FIG. 4.
Figure 6:
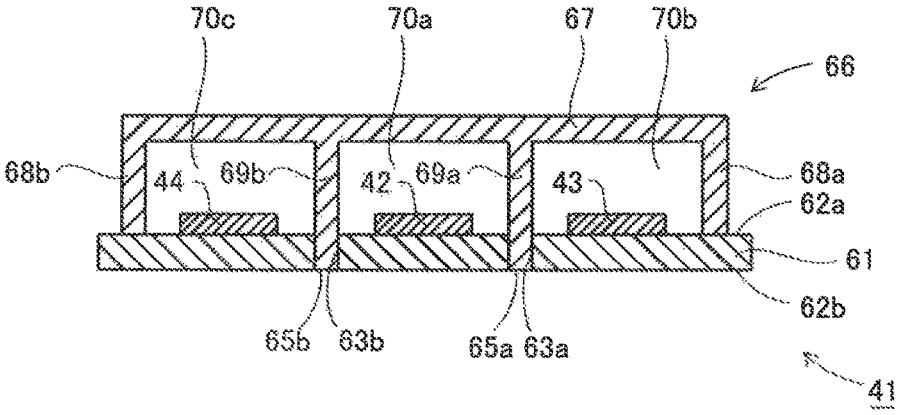
FIG. 6 is a cross-sectional view in which the toner amount detection sensor illustrated in FIG. 4 is partially cut.

Next, the configuration of the toner amount detection sensor 41 according to one embodiment of this disclosure is described. FIG. 4 is a schematic perspective view illustrating the appearance of the toner amount detection sensor 41 according to one embodiment of this disclosure. FIG. 5 is a view illustrating the configuration of the toner amount detection sensor 41 illustrated in FIG. 4. FIG. 6 is a cross-sectional view in which the toner amount detection sensor 41 illustrated in FIG. 4 is partially cut. In FIG. 3, the toner amount detection sensor 41 is schematically illustrated by the chain double-dashed lines. In FIG. 4, the illustration of a case housing described later is omitted from the viewpoint of ease of understanding. In FIG. 5, the illustration of the case housing and a substrate described later is omitted from the viewpoint of ease of understanding.

With reference to FIG. 1 to FIG. 6, the toner amount detection sensor 41 is disposed on the downstream side of the black image producing unit 32*d*. The toner amount detection sensor 41 has a light emitting element 42, a first light receiving element 43, a second light receiving element 44, a toner amount calculation unit 45, a substrate 61, and a case housing 66. The light emitting element 42 emits light to the transfer belt 35 side. The first light receiving element 43 receives light equivalent to a specular reflection light reflected from the side of the surface 38 of the transfer body 35. The second light receiving element 44 is provided separately from the first light receiving element 43. The second light receiving element 44 receives a diffuse-reflected light reflected from the side of the surface 38 of the transfer body 35. The toner amount calculation unit 45 calculates the toner amount from the light quantity of the light equivalent to the specular reflection light received by the first light receiving element 43 and the light quantity of the diffuse-reflected light received by the second light receiving element 44. As an example of the light emitting element 42, an infrared light emitting diode emitting infrared light is specifically employed. As an example of the first light receiving element 43 and the second light receiving element 44, an infrared light receiving element is specifically employed.

The light emitting element 42 emits a light 46*a*, such as infrared light, in the obliquely upper left direction indicated by the arrow $E_1$ in FIG. 5 toward the surface 38 of the transfer belt 35 or the visible image 39 by toner. In the emission of the light 46*a*, the light 46*a* is emitted at an angle of incidence $A_1$ illustrated in FIG. 5. The angle $A_1$ is an angle formed by a plane 49*c* extending in a direction perpendicular to the surface 38 of the transfer belt 35 illustrated by the alternate long and short dash lines and the emission direction of the light 46*a*. In this embodiment, the angle $A_1$ is also an angle at which the light emitting element 42 is disposed with respect to the plane 48.

The first light receiving element 43 is provided on the side opposite to the light emitting element 42 with respect to the plane 48 extending in a direction perpendicular to the surface 38 of the transfer belt 35. The first light receiving element 43 receives either a light 46*b* equivalent to the specular reflection light from the visible image 39 by toner traveling toward the obliquely lower left direction indicated by the arrow $E_2$ in FIG. 5 or a light 46*b* equivalent to the specular reflection light from the surface 38 of the transfer belt 35 or a light 46*b* equivalent to the specular reflection light from both the visible image 39 by toner and the surface 38 of the transfer belt 35. When the visible image 39 by toner completely covers the surface 38 of the transfer belt 35, only the light 46*b* equivalent to the specular reflection light from the visible image 39 by toner is received. Unless the visible image 39 by toner is formed on the surface 38 of the transfer belt 35, only the light 46*b* equivalent to the specular reflection light from the surface 38 of the transfer belt 35 is received. When the visible image 39 by toner does not completely cover the surface 38 of the transfer belt 35 and the toner amount of the visible image 39 by toner is small, the light 46*b* equivalent to the specular reflection light from both the visible image 39 by toner and the surface 38 of the transfer belt 35 is received. In receiving the light 46*b* equivalent to the specular reflection light, the light 46*b* equivalent to the specular reflection light is received at the angle $A_2$ illustrated in FIG. 5. In this embodiment, the angle $A_2$ is an angle at which the first light receiving element 43 is disposed with respect to the plane 48. For reference, the direction of the specular reflection light specular reflected at the angle $A_1$ is illustrated by dashed lines 47.

The second light receiving element 44 is provided on the same side as the side on which the light emitting element 42 is provided with respect to the plane 48 extending in the direction perpendicular to the surface 38 of the transfer belt 35. The second light receiving element 44 receives either a diffuse-reflected light 46*c* from the visible image 39 by toner traveling toward the obliquely lower left direction indicated by the arrow $E_3$ in FIG. 5 or a diffuse-reflected light 46*c* from the surface 38 of the transfer belt 35 or a diffuse-reflected light 46*c* from both the visible image 39 by toner and the surface 38 of the transfer belt 35. When the visible image 39 by toner completely covers the surface 38 of the transfer belt 35, only the diffuse-reflected light 46*c* from the visible image 39 by toner is received. Unless the visible image 39 by toner is formed on the surface 38 of the transfer belt 35, only the diffuse-reflected light 46*c* from the surface 38 of the transfer belt 35 is received. When the visible image 39 by toner does not completely cover the surface 38 of the transfer belt 35 and the toner amount of the visible image 39 by toner is small, the diffuse-reflected light 46*c* from both the visible image 39 by toner and the surface 38 of the transfer belt 35 is received. In receiving the diffuse-reflected light 46*c*, the diffuse-reflected light 46*c* is received at the angle $A_3$ illustrated in FIG. 5. In this embodiment, the angle $A_3$ is an angle at which the second light receiving element 44 is arranged with respect to the plane 48.

The light emitting element 42 irradiates the transfer belt 35 on the surface 38 of which the visible image 39 by toner is formed with the light 46*a* in the direction indicated by the arrow $E_1$ in FIG. 5. The light 46*a* hits either or both of the visible image 39 by toner and the surface 38 of the transfer belt 35 to be reflected. Among the reflected lights, the light 46*b* equivalent to a specular reflection light is received by the first light receiving element 43 disposed at an angle tilted by the angle $A_2$ with respect to the plane 48. Among the reflected lights, a diffuse-reflected light is received by the second light receiving element 44 disposed at an angle tilted by the angle $A_3$ with respect to the plane 48. The first light receiving element 43 and the second light receiving element 44 each output a current corresponding to the light quantity of the received light. The toner amount calculation unit 45 converts the current output by each of the first light receiving element 43 and the second light receiving element 44 to a voltage. Then, the toner amount is calculated based on these voltage values. Thus, the toner amount detection sensor 41 detects the toner amount.

Figure 7:
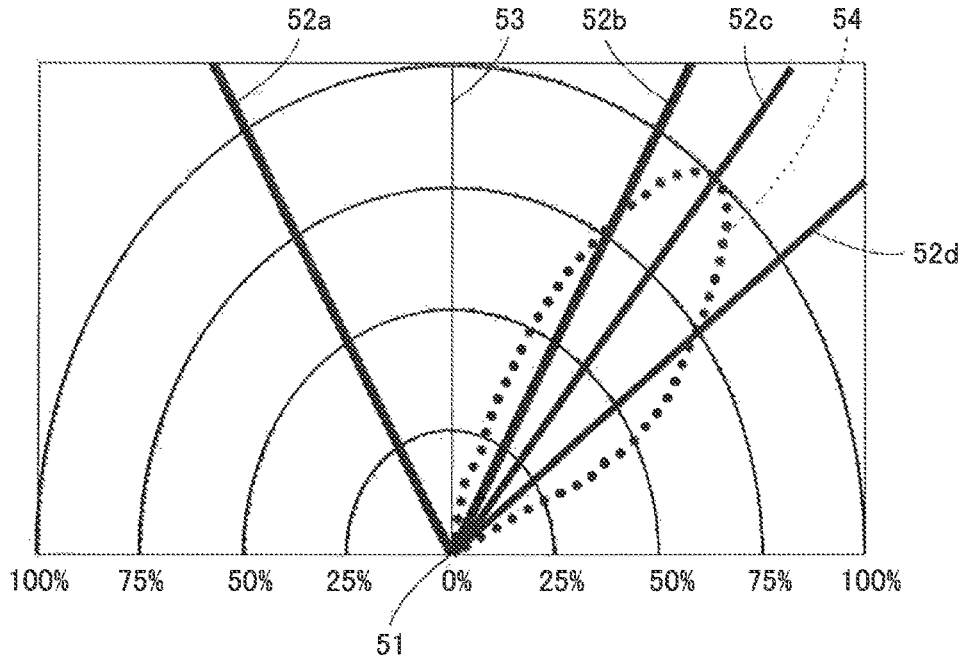
FIG. 7 is a graph illustrating the relationship between the reflectivity of the surface of a transfer belt and the reflection angle with respect to incident light.

FIG. 7 illustrates a graph showing the relationship between the reflectivity of the surface 38 of the transfer belt 35 and the reflection angle with respect to the incident light. The position at the scale of 0% located at a center 51 in FIG. 7 shows the light emission position. In FIG. 7, the scale lines are drawn at the positions of 25% reflectivity, 50% reflectivity, 75% reflectivity, and 100% reflectivity in the concentric semicircular shape centering on the center 51. Moreover, the incident light is indicated by a solid line 52*a* and a specular reflection light is indicated by a solid line 52*b*. A line equivalent to the plane extending in the direction perpendicular to the reflected plane is indicated by a solid line 53. A dotted line 54 indicates the reflectivity of the surface 38 of the transfer belt 35 within the range of a certain reflection angle.

With reference to FIG. 7, the angle formed by the solid line 52*a* and the solid line 53 is equivalent to the angle $A_1$ described above and is set to 30°. The angle formed by the solid line 52*b* and the solid line 53 is also equivalent to the angle $A_1$ described above and is set to 30°. The point where the solid line 52*b* and the dotted line 54 cross shows the reflectivity when the incident light is specular reflected and is about 75%. The reflectivity gradually increases as the reflection angle becomes larger than the angle $A_1$. In this case, when the reflection angle indicated by the solid line 52*c* is 40°, the reflectivity is almost 100%, and the reflectivity reaches the maximum at the reflection angle. Then, the reflectivity gradually decreases with an increase in the reflection angle, so that the reflectivity reaches about 75% equivalent to the reflectivity when specular reflected at the reflection angle of 45° indicated by the solid line 52*d*. Accordingly, due to the fact that the relationship of $A_1<A_2<1.5A_1$ is established in the relationship between the angle $A_1$ and the angle $A_2$, light can be received with reflectivity higher than that at the specular reflected position. Therefore, when configured as described above, a large light quantity of light reflected from the surface 38 of the transfer belt 35 can be received when the visible image 39 by toner is not formed on the surface 38 of the transfer belt 35. Also when the visible image 39 by toner does not completely cover the surface 38 of the transfer belt 35 and the toner amount of the visible image 39 by toner is small, the light quantity of the light transmitting through a toner layer to hit the surface 38 of the transfer belt 35 to be reflected can be correctly detected. Therefore, the toner amount is detectable with good accuracy.

The reason therefor is presumed as follows. More specifically, the surface 38 of the transfer belt 35 is very thinly covered with a certain coating agent for reasons of an improvement of the toner transfer efficiency, protection of the surface 38 of the transfer belt 35, and the like. Incident light is refracted or scattered due to the type of the coating agent, the thickness of a coat layer, and the like. It is considered that the above-described tendency, i.e., the tendency for the reflectivity to increase at an angle larger than that of the specular reflection, appears due to the influence of the refraction or the scattering of the incident light. Examples of the type of the coating agent include polyamide resin, polyamideimide resin, polyimide resin, polycarbonate resin, and the like, for example.

Therefore, when the angle $A_1$ is set to 30°, the angle $A_2$ may be set to be larger than 30° and 45° or less, for example. Thus, light can be received in the range where higher reflectivity of a specular reflection light is shown. Specifically, the angle $A_2$ is set to 35° or 40°. With respect to the angle $A_2$, an arbitrary value in the range mentioned above, i.e., the range of larger than 30° and 45° or less, is selected depending on the material and the like of the transfer belt 35. For example, when the transfer belt 35 is made of resin containing at least any one selected from the group of polyamideimide resin, polyimide resin, and polycarbonate resin as the material of the transfer belt 35, the angle $A_2$ may be set to 35°. When the transfer belt 35 is made of rubber containing at least any one of urethane rubber and hydrin rubber as the material of the transfer belt 35, the angle $A_2$ may be set to 40°.

Herein, the light emitting element 42, the first light receiving element 43, and the second light receiving element 44 are attached to the substrate 61. Specifically, the light emitting element 42, the first light receiving element 43, and the second light receiving element 44 are attached with an interval to the same first surface 62*a* which is one surface of the substrate 61. The substrate 61 has a thin plate shape and has an approximately rectangular shape. As the material of the substrate 61, the substrate 61 is made of glass epoxy resin. More specifically, the substrate 61 is transparent to such a degree that light transmits therethrough.

In the substrate 61, a first slit 63*a* and a second slit 63*b* are formed. The first slit 63*a* is formed between a region where the light emitting element 42 is provided and a region where the first light receiving element 43 is provided. The second slit 63*b* is provided between the region where the light emitting element 42 is provided and a region where the second light receiving element 44 is provided. The first and second slit 63*a* and 63*bs* each are formed in such a manner as to be notched diagonally from one end surface 64*a* located on the long side of the rectangular substrate 61. The first and second slits 63*a* and 63*b* are provided in such a manner as to incline in different directions. The first and second slits 63*a* and 63*b* are provided in such a manner as to penetrate in a plate thickness direction.

The case housing 66 is attached to the substrate 61. Specifically, the case housing 66 is attached to the first surface 62*a* side of the substrate 61 on which the light emitting element 42 and the like are provided.

The case housing 66 includes a top plate portion 67, a pair of side walls 68*a* and 68*b*, a first light shielding wall 69*a*, and a second light shielding wall 69*b*. The pair of side walls 68*a* and 68*b*, the first light shielding wall 69*a*, and the second light shielding wall 69*b* each are provided with an interval in such a manner as to extend in a vertical direction from the top plate portion 67. The case housing 66 is configured so that, when attached to the substrate 61, the top plate portion 67 covers the upper surface side of the light emitting element 42, the first light receiving element 43, and the second light receiving element 44. The case housing 66 is configured so that the first light shielding wall 69*a* and the second light shielding wall 69*b* are longer than the pair of side walls 68*a* and 68*b*.

The case housing 66 is integrally molded. As the material of the case housing 66, the case housing 66 is made of polycarbonate resin or ABS (Acrylonitrile-Butadiene-Styrene) resin. The case housing 66 including the first light shielding wall 69*a* and the second light shielding wall 69*b* is configured from materials through which light does not penetrate.

The case housing 66 is attached to the substrate 61 in such a manner that the first light shielding wall 69*a* is fitted into the first slit 63*a* and the second light shielding wall 69*b* is fitted into the second slit 63*b*. An end portion 65*a* of the first light shielding wall 69*a* and an end portion 65*b* of the second light shielding wall 69*b* each are fitted in such a manner as to reach a second surface 62*b* of the substrate 61. The light emitting element 42 is disposed in space 70*a* partitioned by the first light shielding wall 69*a*, the second light shielding wall 69*b*, the top plate portion 67, and the substrate 61. The first light receiving element 43 is disposed in space 70*b* partitioned by the side wall 68*a*, the first light shielding wall 69*a*, the top plate portion 67, and the substrate 61. The second light receiving element 44 is disposed in space 70*c* partitioned by the side wall 68*b*, the second light shielding wall 69*b*, the top plate portion 67, and the substrate 61.

Such a toner amount detection sensor 41 can shield light from the light emitting element 42 which penetrates the inside of the substrate 61 with the first light shielding wall 69*a* and the second light shielding wall 69*b* when the first light receiving element 43 and the second light receiving element 44 receive a reflected light reflected from the surface 38 side of the transfer belt 35. The upper side of the light emitting element 42, the first light receiving element 43, and the second light receiving element 44 is covered with the case housing 66. Thus, the first light receiving element 43 and the second light receiving element 44 are not affected by light from the light emitting element 42 or light from the outside. Therefore, the first light receiving element 43 and the second light receiving element 44 receive a reflected light from the surface 38 side of the transfer belt 35 to be able to correctly detect each of the light quantity of light equivalent to a specular reflection light and the light quantity of a diffuse-reflected light, so that the toner amount is detectable with good accuracy.

In this case, the first light shielding wall 69*a* and the second light shielding wall 69*b* are provided in such a manner as to extend to reach the second surface 62*b* of the substrate 61, and therefore the light from the light emitting element 42 which penetrates the inside of the substrate 61 can be more certainly shielded with the first light shielding wall 69*a* and the second light shielding wall 69*b*.

In this case, the relationship of $A_1<A_2<1.5A_1$ is established, and therefore the toner amount is detectable with better accuracy.

Figure 8:
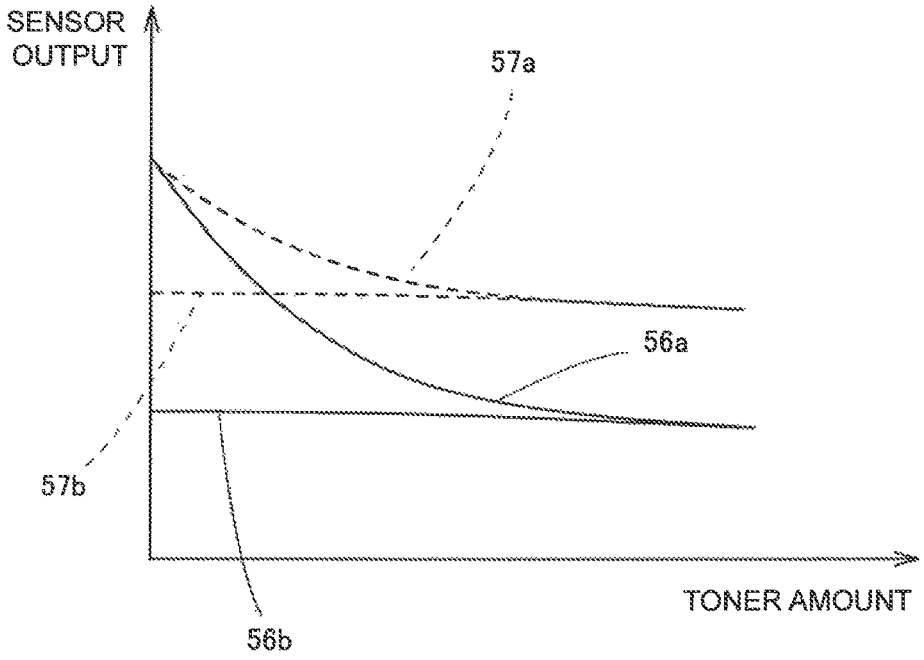
FIG. 8 is a graph illustrating the relationship between the toner amount and an output of the toner amount detection sensor when detecting the toner amount of a visible image by black toner.
Figure 9:
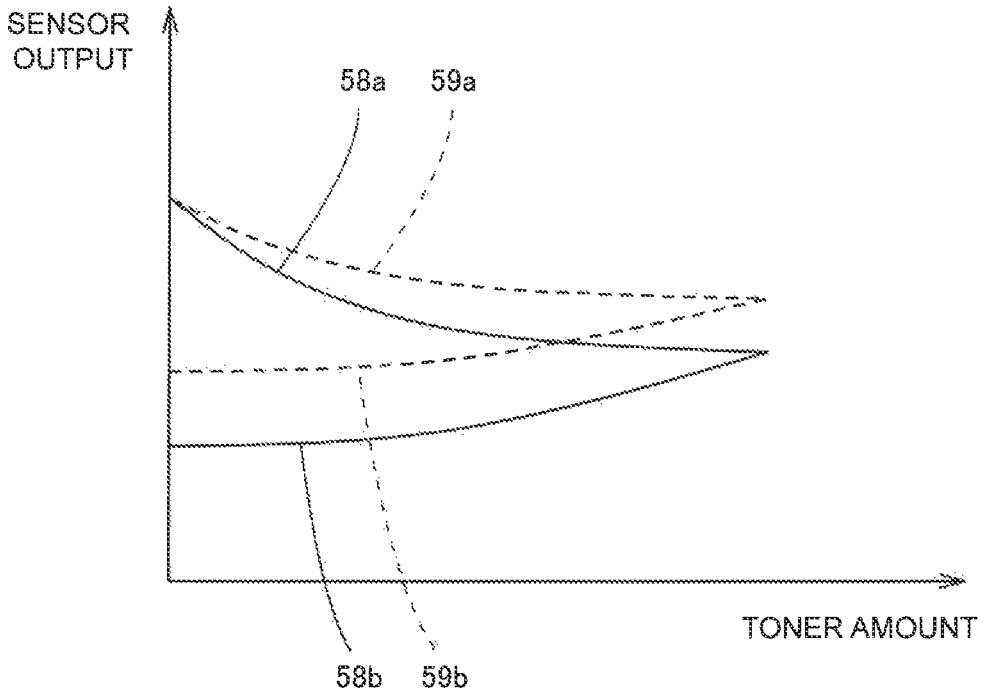
FIG. 9 is a graph illustrating the relationship between the toner amount and an output of the toner amount detection sensor when detecting the toner amount of a visible image by yellow toner.

FIG. 8 is a graph showing the approximate relationship between the toner amount and an output of the toner amount detection sensor 41 in the case of detecting the toner amount of the visible image 39 by black toner. FIG. 9 is a graph showing the approximate relationship between the toner amount and an output of the toner amount detection sensor 41 in the case of detecting the toner amount of the visible image 39 by yellow toner. The approximate relationship between the toner amount and an output of the toner amount detection sensor 41 in the case of detecting the toner amount of the visible image 39 by cyan toner and the approximate relationship between the toner amount and an output of the toner amount detection sensor 41 in the case of detecting the toner amount of the visible image 39 by magenta toner are equivalent to the approximate relationship between the toner amount and the output of the toner amount detection sensor in the case of detecting the toner amount of the visible image 39 by yellow toner, and therefore a description thereof is omitted.

In FIG. 8 and FIG. 9, the vertical axis represents an output value of the toner amount detection sensor 41 and the horizontal axis represents the toner amount. With respect to the vertical axis, the numerical value increases toward the upper side of the sheet. With respect to the horizontal axis, the numerical value increases toward the right side of the sheet. An upper dotted line 57*a* in FIG. 8 represents an output value output based on the quantity of a light received by the first light receiving element 43 when the light emitting element 42, the first light receiving element 43, and the second light receiving element 44 are attached as they are to the substrate 61. A lower dotted line 57*b* represents an output value output based on the quantity of a light received by the second light receiving element 44 when the light emitting element 42, the first light receiving element 43, and the second light receiving element 44 are attached as they are to the substrate 61. An upper solid line 56*a* in FIG. 8 represents an output value output based on the quantity of a light received by the first light receiving element 43 in the case of the configuration illustrated in FIG. 4 to FIG. 6. A lower solid line 56*b* represents an output value output based on the quantity of a light received by the second light receiving element 44 in the case of the configuration illustrated in FIG. 4 to FIG. 6. An upper dotted line 59*a* in FIG. 9 represents an output value output based on the quantity of a light received by the first light receiving element 43 when the light emitting element 42, the first light receiving element 43, and the second light receiving element 44 are attached as they are to the substrate 61. A lower dotted line 59*b* represents an output value output based on the quantity of a light received by the second light receiving element 44 when the light emitting element 42, the first light receiving element 43, and the second light receiving element 44 are attached as they are to the substrate 61. An upper solid line 58*a* in FIG. 9 represents an output value output based on the quantity of a light received by the first light receiving element 43 in the case of the configuration illustrated in FIG. 4 to FIG. 6. A lower solid line 58*b* represents an output value output based on the quantity of a light received by the second light receiving element 44 in the case of the configuration illustrated in FIG. 4 to FIG. 6.

First, with reference to FIG. 8, in the case of the visible image 39 by black toner, when the toner amount is close to 0 and is very small, the output value based on the quantity of the light received by the first light receiving element 43 shown by the dotted line 57*a* when the light emitting element 42, the first light receiving element 43, and the second light receiving element 44 are attached as they are to the substrate 61 is not so different from the output value based on the quantity of the light received by the first light receiving element 43 shown by the solid line 56*a* in the case of the configuration illustrated in FIG. 4 to FIG. 6. Herein, with an increase in the toner amount, the output value based on the quantity of the light received by the first light receiving element 43 shown by the dotted line 57*a* when the light emitting element 42, the first light receiving element 43, and the second light receiving element 44 are attached as they are to the substrate 6 and the output value based on the quantity of the light received by the first light receiving element 43 shown by the solid line 56*a* in the case of the configuration illustrated in FIG. 4 to FIG. 6 each gradually decrease. However, the decrease degree of the output value based on the quantity of the light received by the first light receiving element 43 shown by the solid line 56*a* in the case of the configuration illustrated in FIG. 4 to FIG. 6 is larger.

With respect to the output value based on the light quantity of the light received by the second light emitting element 44, changes according to the toner amount are not observed in the case of the output value shown by the dotted line 57*a* when the light emitting element 42 and so on are attached as they are to the substrate 61 and in the case of the output value shown by the solid line 56*a* in the configuration illustrated in FIG. 4 to FIG. 6. The output value based on the light quantity of the light received by the second light receiving element 44 shown by the dotted line 57*a* when the light emitting element 42 and so on are attached as they are to the substrate 61 is larger than the output value based on the light quantity of the light received by the second light receiving element 44 shown by the solid line 56*a* in the case of the configuration illustrated in FIG. 4 to FIG. 6.

More specifically, in the configuration illustrated in FIG. 4 to FIG. 6 shown by the solid lines 56*a* and 56*b*, light other than the reflected light from the surface 38 side of the transfer belt 35 is hardly received and wide sensitivity of the sensor output according to the toner amount is obtained. Therefore, from the state where there is no toner, i.e., the state where the visible image 39 by toner is not formed and the surface 38 of the transfer belt 35 is detected, to the state where the amount of the toner covering the surface 38 of the transfer belt 35 is detected, the width of the output value of the toner amount detection sensor 41 can be kept wider, and toner amount detection with high accuracy can be performed.

Next, with reference to FIG. 9, similarly also in the case of the visible image 39 by yellow toner, when the toner amount is close to 0 and is very small, the output value based on the light quantity of the light received by the first light receiving element 43 shown by the dotted line 59*a* when the light emitting element 42 and so on are attached as they are to the substrate 61 is not so different from the output value based on the light quantity of the light received by the first light receiving element 43 shown by the solid line 58*a* in the case of the configuration illustrated in FIG. 4 to FIG. 6. Herein, with an increase in the toner amount, the output value based on the quantity of the light received by the first light receiving element 43 shown by the dotted line 59*a* when the light emitting element 42 and so on are attached as they are to the substrate 6 and the output value based on the quantity of the light received by the first light receiving element 43 shown by the solid line 58*a* in the case of the configuration illustrated in FIG. 4 to FIG. 6 each gradually decrease. However, the decrease degree of the output value based on the quantity of the light received by the first light receiving element 43 shown by the solid line 58*a* in the case of the configuration illustrated in FIG. 4 to FIG. 6 is larger.

When the toner amount is close to 0 and is very small, the output value based on the light quantity of the light received by the second light receiving element 44 shown by the dotted line 59*b* when the light emitting element 42 and so on are attached as they are to the substrate 61 is larger than the output value based on the light quantity of the light received by the second light receiving element 44 shown by the solid line 58*b* in the configuration illustrated in FIG. 4 to FIG. 6. The output values each increase with an increase in the toner amount.

More specifically, also in this case, in the configuration illustrated in FIG. 4 to FIG. 6 shown by the solid lines 58*a* and 58*b*, light other than the reflected light from the surface 38 side of the transfer belt 35 is hardly received and wide sensitivity of the sensor output according to the toner amount is obtained. Therefore, from the state where there is no toner, i.e., the state where the visible image 39 by toner is not formed and the surface 38 of the transfer belt 35 is detected, to the state where the amount of the toner covering the surface 38 of the transfer belt 35 is detected, the width of the output value of the toner amount detection sensor 41 can be kept wider, and toner amount detection with high accuracy can be performed.

As described above, according to such a toner amount detection sensor 41, the toner amount is detectable with good accuracy.

Moreover, according to such a multifunctional peripheral 11, the image quality of an image to be formed can be improved.

In the embodiment described above, the first light shielding wall 69*a* and the second light shielding wall 69*b* are provided so as to prevent the direct entrance of light from the light emitting element 42 to the first light receiving element 43 and the second light receiving element 44, respectively. However, the embodiment is not limited thereto and a configuration of providing at least either the first light shielding wall 69*a* or the second light shielding wall 69*b* may be acceptable. Thus, an adverse effect due to the direct entrance of light from the light emitting element 42 can be prevented, and the toner amount is detectable with good accuracy.

Moreover, in the embodiment described above, the first light shielding wall 69*a* and the second light shielding wall 69*b* are fitted into the first slit 63*a* and the second slit 63*b*, respectively. However, the embodiment is not limited thereto and a configuration in which the first light shielding wall 69*a* and the second light shielding wall 69*b* are disposed in the first slit 63*a* and the second slit 63*b*, respectively, may be acceptable.

In the embodiment described above, the first slit 63*a* and the second slit 63*b* are provided in such a manner as to penetrate the substrate 61 in a plate thickness direction. However, the embodiment is not limited thereto and the first slit 63*a* and the second slit 63*b* may have a shape dented in a groove shape from the surface 62*a* to which the case housing 66 is attached.

In the embodiment described above, it may be configured so that a polarized light having a predetermined wavelength is emitted from the light emitting element 42, a polarized light having a predetermined wavelength among reflected lights is separated and received by the first light receiving element 43 and the second light receiving element 44, and then the toner amount is detected based on the light quantity. According to such a configuration, the toner amount is detectable using polarized lights, such as P wave and an S wave, based on each light quantity.

In the embodiment described above, as the material of the transfer belt 35 made of resin, the transfer belt 35 is made of polyimide resin but the material is not limited thereto and the material of the transfer belt may be any one of polyamideimide resin, polyimide resin, or polycarbonate resin, for example. As the material of the transfer belt 35 made of rubber, urethane rubber is used, but the material is not limited thereto and hydrin rubber may be used. More specifically, it may be configured so that, as the material of the transfer, at least any one of polyamide resin, polyamideimide resin, polyimide resin, polycarbonate resin, urethane rubber, and hydrin rubber is contained.

In the embodiment described above, an infrared light emitting diode emitting infrared light is mentioned as an example of the light emitting element 42 and an infrared light receiving element is employed as an example of the first light receiving element 43 and the second light receiving element 44. However, the embodiment is not limited thereto and the light emitting element 42 emitting lights having other wavelengths, such as visible light, and the first light receiving element 43 and the second light receiving element 44 receiving lights having other wavelengths may be used.

In the embodiment described above, angles other than the angles described above may be selected for the angle $A_1$. In the embodiment described above, the angle at which the first light receiving element 43 is attached is defined as the angle $A_2$ but is not limited thereto and the angle $A_2$ at which the first light receiving element 43 is attached may be the same as the angle $A_1$. More specifically, as the light equivalent to a specular reflection light, a specular reflection light itself may be received by the first light receiving element 43.

In the embodiment described above, the transfer belt 35 which is an intermediate transfer body is used as the transfer body but is not limited thereto and this disclosure is applied even when the transfer body is a photoconductor and the like, for example.

In the embodiment described above, the toner amount detection sensor 41, the first light receiving element 43, and the second light receiving element 44 are contained but a configuration of having only either one of the light receiving elements 43 and 44 may be acceptable. More specifically, the toner amount may be detected using, for example, a reflected light or the like received by either one of the light receiving elements 43 and 44.

The embodiments and examples as disclosed herein should be understood to be illustrative in all respects and not restrictive in any aspect. The scope of the disclosure is specified not by the foregoing description but by Claims, and all alternations that come within the meaning and range of equivalency of Claims are to be embraced within its scope.

The toner amount detection sensor and the image forming apparatus according to this disclosure are particularly effectively utilized when an improvement of the image quality of an image to be formed is required.

What is claimed is:

1. A toner amount detection sensor detecting a toner amount of a visible image by toner formed on a surface of a transfer body, the toner amount detection sensor comprising:

a light emitting element emitting light to a side of the surface of the transfer body at a predetermined angle of incidence;

a light receiving element receiving a reflected light reflected from the side of the surface of the transfer body;

a toner amount calculation unit calculating the toner amount from a light quantity of the reflected light received by the light receiving element;

a substrate on which the light emitting element and the light receiving element are attached with an interval to a same first surface; and a case housing attached to the substrate and covering an upper surface side of the light emitting element and the light receiving element, wherein the case housing has a top plate portion and a pair of side walls, in the substrate, a slit is formed between a region where the light emitting element is attached and a region where the light receiving element is attached, and the case housing is provided with a light shielding wall which is disposed in such a manner as to extend to reach an inside of the slit when attached to the substrate and which shields light between the light emitting element and the light receiving element, the light receiving element has a first light receiving element receiving a specular reflection light from the side of the surface of the transfer body and a second light receiving element receiving a diffuse-reflected light from the side of the surface of the transfer body, the slit has a first slit provided between a region where the first light receiving element is provided and a region where the light emitting element is provided, and a second slit provided between a region where the second light receiving element is provided and the region where the light emitting element is provided, the light shielding wall has a first light shielding wall disposed in such a manner as to extend to reach an inside of the first slit and to shield light between the light emitting element and the first light receiving element, and a second light shielding wall disposed in such a manner as to extend to reach an inside of the second slit and to shield light between the light emitting element and the second light receiving element, the pair of side walls, the first light shielding wall, and the second light shielding wall each are provided with an interval in such a manner as to extend in a vertical direction from the top plate portion, and all wall surfaces of the pair of side walls, the first light shielding wall, and the second light shielding wall are flat surfaces.

2. The toner amount detection sensor according to claim 1, wherein the light shielding wall is provided in such a manner as to reach a second surface of the substrate on which the light emitting element and the light receiving element are not provided.

3. The toner amount detection sensor according to claim 1, wherein the light shielding wall is fitted into the slit.

4. The toner amount detection sensor according to claim 1, wherein when the predetermined angle of incidence to a plane extending in a direction perpendicular to the surface of the transfer body is defined as an angle $A_1$ and an angle at which the first light receiving element is disposed with respect to the plane extending in the direction perpendicular to the surface of the transfer body is defined as an angle $A_2$, a relationship of $A_1<A_2<1.5A_1$ is established.

5. The toner amount detection sensor according to claim 1, wherein the second light receiving element is provided on a side opposite to the first light receiving element with the light emitting element interposed between the first light receiving element and the second light receiving element.

6. The toner amount detection sensor according to claim 1, wherein the substrate is made of glass epoxy resin, and the light shielding wall is made of polycarbonate resin or ABS, acrylonitrile-butadiene-styrene resin.

7. The toner amount detection sensor according to claim 1, wherein the transfer body contains a transfer belt, and a material of the transfer belt contains at least any one of polyamide resin, polyamideimide resin, polyimide resin, polycarbonate resin, urethane rubber, and hydrin rubber.

8. An image forming apparatus comprising:

an image forming unit forming a visible image by toner and having a toner amount detection sensor detecting a toner amount of the visible image by toner formed on a surface of a transfer body, wherein the toner amount detection sensor has a light emitting element emitting light to a side of the surface the transfer body at a predetermined angle of incidence, a light receiving element receiving a reflected light reflected from the surface side of the transfer body, a toner amount calculation unit calculating the toner amount from a light quantity of the reflected light received by the light receiving element, a substrate on which the light emitting element and the light receiving element are attached with an interval to a same first surface; and a case housing attached to the substrate and covering an upper surface side of the light emitting element and the light receiving element, wherein the case housing has a top plate portion and a pair of side walls, in the substrate, a slit is formed between a region where the light emitting element is attached and a region where the light receiving element is attached, and the case housing is provided with a light shielding wall which is disposed in such a manner as to extend to reach an inside of the slit when attached to the substrate and which shields light between the light emitting element and the light receiving element the light receiving element has a first light receiving element receiving a specular reflection light from the side of the surface of the transfer body and a second light receiving element receiving a diffuse-reflected light from the side of the surface of the transfer body, the slit has a first slit provided between a region where the first light receiving element is provided and a region where the light emitting element is provided, and a second slit provided between a region where the second light receiving element is provided and the region where the light emitting element is provided, the light shielding wall has a first light shielding wall disposed in such a manner as to extend to reach an inside of the first slit and to shield light between the light emitting element and the first light receiving element, and a second light shielding wall disposed in such a manner as to extend to reach an inside of the second slit and to shield light between the light emitting element and the second light receiving element, the pair of side walls, the first light shielding wall, and the second light shielding wall each are provided with an interval in such a manner as to extend in a vertical direction from the top plate portion, and all wall surface of the pair of side walls, the first light shielding wall, and the second light shielding wall are flat surfaces.

* * * * *